United States Patent [19]

Ishida et al.

[11] Patent Number: 4,529,992

[45] Date of Patent: Jul. 16, 1985

[54] MULTICOLOR RECORD MATERIAL

[75] Inventors: Katsuhiko Ishida, Takatsuki; Tomoyuki Okimoto, Nishinomiya; Tosaku Okamoto, Osaka, all of Japan

[73] Assignee: Kanzaki Paper Manufacturing Co., Ltd., Tokyo, Japan

[21] Appl. No.: 547,493

[22] Filed: Nov. 1, 1983

[30] Foreign Application Priority Data

Nov. 13, 1982 [JP] Japan ..... 57-199424

[51] Int. Cl.[3] ..... B41M 5/18

[52] U.S. Cl. ..... 346/204; 346/207; 346/209; 346/226; 427/150; 427/151; 427/152; 428/212; 430/945

[58] Field of Search ..... 282/27.5; 427/150–153; 428/320.4–320.8, 411, 488, 537, 913, 914, 212, 411.1, 488.1, 537.5; 430/945; 346/204, 207, 209, 226

[56] References Cited

U.S. PATENT DOCUMENTS 4,394,661 7/1983 Peeters ..... 430/945

FOREIGN PATENT DOCUMENTS 131142 12/1974 Japan ..... 346/204

*Primary Examiner*—Bruce H. Hess

*Attorney, Agent, or Firm*—Larson and Taylor

[57] ABSTRACT

This invention provides a multicolor record material comprising a plurality of color forming systems each containing a color forming material and a color developing material and adapted to produce different colors individually, the multicolor record material being characterized in that each of the systems contains a substance which absorbs an infrared beam of specified wavelength for causing the system to produce its color but which substantially does not absorb an infrared beam of different wavelength for causing another system to produce the color thereof.

10 Claims, No Drawings

MULTICOLOR RECORD MATERIAL

This invention relates to record materials adapted to form color images with use of the energy of infrared rays, and more particularly to a record material for forming multicolor images thereon with use of infrared beams which are different in wavelength.

Heat-sensitive record materials are well known wherein a color forming material and a color developing material are adapted to come into contact with each other by heat to undergo a color forming reaction and produce color images. For recording, a record head (thermal head) is generally used to scan the record layer of the heat-sensitive material in intimate contact therewith. This method, however, is susceptible to troubles such as wear of the head, adhesion of dust or like particles to the tip of the head and sticking of the head to the record layer. Furthermore, the method is not suited to high-speed recording because the recording speed is dependent on the duration of release of heat from the thermal head, while there is a limitation to the resolution of color images due to the diffusion of heat. In place of the contact scanning method with use of the thermal head, therefore, various non-contact recording techniques have been proposed wherein a lasser beam or like light beam having a high energy density is used for scanning.

On the other hand, there is a growing demand for multicolor record materials. For example, heat-sensitive multicolor record materials have been proposed which, for example, comprise at least two color forming systems each containing a color forming material and a color developing material in layers or in the form of a mixed layer. These systems are made different in the combination of component materials so as to be different in color forming temperature. The record material of this type is brought into contact with heaters (e.g. thermal heads) which are heated at different temperatures or is irradiated with laser beams of single wavelength which differ in output, whereby the color forming systems are made to produce colors at different temperatures.

Such heat-sensitive multicolor record materials are so adapted that each color forming system is given a required amount of heat and thereby melted to effect a color forming reaction between the color forming material and the color developing material within the system. Accordingly when one system which becomes reactive at a higher temperature is caused to form a color by the recording means (whichever of thermal head and laser beam), another system which becomes reactive at a lower temperature invariably produces its color by being heated by the recording means before the higher-temperature color forming system produces its color. Consequently, it was not possible to produce the inherent color of the higher-temperature color forming system, and such conventional heat-sensitive multicolor record material invariably gives only a mixture of the color of the higher-temperature color forming system and the color of the lower-temperature color forming system. This undesirable phenomenon will hereinafter be referred to as "color mixing". For example, in the conventional dichromatic record material wherein the lower-temperature color forming system is originally designed to form a red color and the higher-temperature color forming system is adapted to form a blue color, the red color of the lower-temperature color forming system can be formed by scanning the record material at a lower temperature. However, when the record material is scanned at a higher temperature, not only the higher-temperature color forming system produces its blue color but also the lower-temperature color forming system produces its red color, thereby giving purple or similar color which is a mixture of blue and red. Thus it is impossible to obtain a record image which has a distinct color contrast.

An object of the present invention is to provide a record material wherein each color forming system can be made to produce a color substantially without the tendency to cause another color forming system to produce a color and which is therefore free from the problem of color mixing. The above object and other features of the present invention will become apparent from the following description.

The present invention provides a multicolor record material comprising a plurality of color forming systems each containing a color forming material and a color developing material and adapted to produce different colors individually, the multicolor record material being characterized in that each of the systems contains a substance which absorbs an infrared beam of specified wavelength for causing the system to produce its color but which substantially does not absorb an infrared beam of different wavelength for causing another system to produce the color thereof.

We have carried out extensive research on multicolor record materials for use with infrared laser beams serving as recording light sources and ranging from 0.8 to 20 μm in wavelength in order to obtain multicolor record materials in which the record layer is free of undesired color and which produce different colors without the problem of color mixing. Consequently we have developed a multicolor record system based on a concept which entirely differs from the concept of conventional heat-sensitive multicolor record materials comprising a plurality of color forming systems each containing a color forming material and a color developing material and each made different from any other system in color forming temperature. The multicolor record material of this invention comprises a plurality of color forming systems each containing a substance which absorbs an infrared beam of specified wavelength for causing the system to produce its color but which substantially does not absorb an infrared beam of different wavelength for causing another system to produce its color. (The substance will hereinafter be referred to as "infrared absorbing substance".) The infrared absorbing substance contained in each system is irradiated with the infrared beam of specified wavelength to cause the system alone to form a color. Thus according to the present invention, there is no need to make the color forming systems different in color forming temperature, but the infrared absorbing substance contained in a particular system and absorbing an infrared beam of specified wavelength is caused to absorb that infrared beam to make the system selectively and limitedly produce its color. Because the infrared absorbing substance contained in any other system substantially does not absorb the infrared beam of specified wavelength, or even if absorbing this infrared beam, will not release such thermal energy as to cause a color forming reaction between the color forming material and the color developing material, substantially no color formation occurs in the system(s) other than the particular one. Accordingly the multicolor record material of the invention does not have the drawback that when one color forming system is caused to form a color, another color forming system is also allowed to form a color. Thus the present invention achieves the excellent effect of avoiding the problem of color mixing.

As already stated, the present invention has an important feature that each record layer contains an infrared absorbing substance which absorbs an infrared beam of specified wavelength selected from a plurality of recording infrared beams of 0.8 to 20 μm in wavelength but which substantially does not absorb the other infrared beams of different wavelengths. Such infrared absorbing substance may be any of inorganic compounds and organic compounds which exhibit relatively strong absorption in the wavelength range of from about 0.8 to about 20 μm, preferably from about 9 to about 11 μm, provided that the absorption wavelength corresponds to the wavelength of the infrared laser beam used for recording. Examples of useful infrared absorbing substances are as follows.

(i) Inorganic compounds

Aluminum oxide and like metal oxides: aluminum hydroxide, magnesium hydroxide and like metal hydroxides; silicate minerals such as olivine group including olivine, garnet group including almandine and spessartine, pyroxene group including enstatite, amphibole group including tremolite and actinolite, mica group including muscovite and biotite, feldspar group including oligoclase and anorthite, silica mineral group including quartz and cristobalite, clay minerals including kaolinite and montmorillonite, etc.; zinc silicate, magnesium silicate, calcium silicate, barium silicate and like silicate compounds; zinc phosphate and like phosphate compounds; trisilicon tetranitride, boron nitride and like nitride compounds; barium sulfate, calcium sulfate, strontium sulfate and like sulfate compounds; calcium carbonate, barium carbonate, magnesium carbonate, zinc carbonate and like carbonate compounds; and potassium nitrate and like nitrate compounds.

(ii) Organic compounds

Triphenyl phosphate, 2-ethylhexyldiphenyl phosphate, furfuryl acetate, bis(1-thio-2-phenolate)nickel-tetrabutylammonium, bis(1-thio-2-naphtholate)nickel-tetrabutylammonium, 1,1'-diethyl-4,4'-quinocarbocyanine iodide, 1,1'-diethyl-6,6'-dichloro-4,4'-quinotricarbocyanine iodide, etc.

Of these infrared absorbing substances, inorganic compounds are preferable which generally have a sharp absorption band and therefore will not adversely affect the color formation of other color forming systems. Of the inorganic compounds, the silicate compounds may be calcined to increase the crystallinity thereof if so desired.

Useful infrared absorbing substances may be serviceable also as color forming materials or color developing substances given later.

Of these infrared absorbing substances, especially preferable are those having an absorption coefficient of at least $10^2$/cm, as measured at a concentration of 1 wt. % in potassium bromide, for the laser beam of specified wavelength to be used, since they give an improved recording sensitivity.

According to the invention, the infrared absorbing substance is used as pulverized into a powder by a roll mill, impact mill or like suitable pulverizer. When required, the powder is more finely pulverized by a sand mill or the like. The smaller the particle size of the powder, the higher will be the sensitivity improving effect, so that the powder is preferably up to about 10 μm, more preferably up to about 5 μm, in particle size. The amount of the absorbing substance to be used varies, for example, with the intensity of the infrared laser light to be used and is therefore not determinable definitely. Generally it is at least about 3 wt. % based on the total solids of the record layer.

However, the infrared absorbing substance, if used in too excessive an amount, is likely to result in a reduced color density, so that the amount is adjusted preferably within the range of from about 3 to about 90 wt. %, more preferably from about 10 to about 80 wt. %.

In order to render the record layers distinctly distinguishable in the color formed, it is desirable to use infrared absorbing substances in such a combination that the absorption wavelength to be used for recording be at least 0.2 μm different from substance to substance.

The color forming systems to be used in this invention are not particularly limited provided that the color forming material and the color developing material therein are in such a combination that they can be brought into contact with each other by heat to undergo a color forming reaction. Examples of useful combinations are the combination of a colorless or pale-colored basic dye and an inorganic or organic acidic material, and the combination of ferric stearate or like metal salt of higher fatty acid and gallic acid or like phenol. The present invention is also applicable to various heat-sensitive record materials wherein a diazonium compound, coupler and basic substance are used in combination to thermally form color (record) images, and is further applicable to record materials wherein the color forming material is caused to produce a color, for example, by a radical derived from an infrared absorbing substance without entailing a substantial thermal change.

When the specific infrared absorbing substance useful for the present invention is used for the combination of a basic dye and an acidic material among other combinations, the substance exhibits an outstanding effect in improving the record sensitivity and also in inhibiting the undesired color formation or so-called fogging of the record layer before use. Thus the above-mentioned combination is especially preferable to use.

Examples of useful colorless or pale-colored basic dyes are those already known and include:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenyl-leucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenylspiro-dinapthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3,6-dimethoxyfluoran, 3,6-diethoxyfluoran, 3,6-dibutoxyfluoran, 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-5-methyl-b 7-dibenzylaminofluoran, 3-diethylamino-7-(N-methyl-N-benzylamino)fluoran, 3,-diethylamino-7-(N-chloroethyl-N-methylamino)fluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluroan, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, etc.

Examples of inorganic or organic acidic materials which undergo a color forming reaction with such basic dyes on contact therewith are those already known, such as inorganic acidic materials including activated clay, acidic clay, attapulgite, bentonite, colloidal silica and aluminum silicate; and organic acidic materials including phenolic compounds such as 4-tert-butylphenol, 4-tert-octylphenol, 4-phenylphenol, 4-acetylphenol, α-naphthol, β-naphthol, hydroquinone, 2,2'-dihydroxydiphenyl, 2,2'-methylenebis-(4-methyl-6-tert-butylphenol), 2,2'-methylenebis-(4-chlorophenol), 4,4'-dihydroxy-diphenylmethane, 4,4'-isopropylidenediphenol, 4,4'-isopropylidenebis-(2-tert-butylphenol), 4,4'-sec-butylidenediphenol, 4,4'-cyclohexylidenediphenol, 4,4'-dihydroxydiphenyl sulfide, 4,4'thiobis-(6-tert-butyl-3-methylphenol), 4,4'-dihydroxydiphenyl sulfone, 4-hydroxybenzoic acid benzylester, 4-hydroxyphthalic acid dimethylester, hydroquinone monobenzyl ether, novolak phenol resins and phenolic polymers; aromatic carboxylic acids such as benzoic acid, p-tert-butylbenzoic acid, trichlorobenzoic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)-salicylic acid, 3,5-di-tert-butylsalicylic acid, 3-phenyl-5-(α,α-dimethylbenzyl)-salicylic acid, 3,5-di-(α-methylbenzyl)salicylic acid and terephthalic acid; also, salts of such phenolic compounds or aromatic carboxylic acids with polyvalent metals such as zinc, magnesium, aluminum, calcium, titanium, manganese, tin and nickel.

For the preparation of the multicolor record material of the present invention, the proportions of the color forming material and the color developing material to be incorporated into the record layer are suitably determined according to the kinds of these materials and are not particularly limited. For example, when the combination of a colorless or pale-colored basic dye and an inorganic or organic acidic material is used, 1 to 50 parts by weight, preferably 3 to 10 parts by weight, of the acidic material is used per part by weight of the dye.

These materials are formulated into a coating composition generally with use of water as a dispersion medium and a stirring or pulverizing device, such as a ball mill, attritor or sand mill, by dispersing the two material at the same time or separately. The specific infrared absorbing substance (in powder form) may be dispersed along with the two materials or added to the resulting dispersion. Usually the coating composition has incorporated therein a binder, such as starches, hydroxyethyl cellulose, methyl cellulose, carboxymethyl cellulose, gelation, casein, gum arabic, polyvinyl alcohol, styrene-maleic anhydride copolymer salt, styrene-acrylic acid copolymer salt, styrene-butadiene copolymer emulsion or the like. The binder is used in an amount of about 2 to about 40% by weight, preferably about 5 to about 25% by weight, based on the total solids content of the composition.

Various auxiliary agents can be further admixed with the coating composition. Examples of useful auxiliary agents are dispersants such as sodium dioctylsulfosuccinate, sodium dodecylbenzenesulfonate, sodium lauryl sulfate and fatty acid metal salts; ultraviolet absorbers of the benzophenone, triazole or like type; defoaming agents; fluorescent dyes; coloring dyes, etc.

When desired for improving the record sensitivity, a sensitizer can be admixed with the composition. Examples of useful sensitizers are stearic acid amide, stearic acid methylenebisamide, oleic acid amide, palmitic acid amide, sperm oleic acid amide and coconut fatty acid amide and like fatty acid amide; waxes such as stearic acid, polyethylene wax, carnauba wax, paraffin wax, calcium stearate and ester wax, etc.

The constructuion of the record layer of the invention will be described in detail with reference to a case wherein the color forming material and the color developing material are adapted to undergo a color forming reaction on heating. However, the invention is of course not limited to this case.

A heat-sensitive dichromatic record layer is prepared by forming a first record layer and a second record layer on a base sheet. The first record layer contains an infrared absorbing substance (hereinafter referred to as "substance A") which absorbs a laser beam of wavelength $\lambda_1$ but which substantially does not absorb a laser beam of wavelength $\lambda_2$, a color forming material and a color developing material. The second record layer contains an infrared absorbing substance (hereinafter referred to as "substance B") which absorbs a laser beam of wavelength $\lambda_2$ but which substantially does not absorb a laser beam of wavelength $\lambda_1$, a color forming material and a color developing material which form a color different from the color to be formed by the first record layer. A heat-sensitive trichromatic record material comprises, in addition to the above record layers, a third record layer containing an infrared absorbing substance which absorbs a laser beam of wavelength $\lambda_3$ but which substantially does not absorb the laser beams of wavelengths $\lambda_1$ and $\lambda_2$. In this case, the substances A and B to be incorporated into the first and second record layers must be those which substantially do not absorb the laser beam of wavelength $\lambda_3$. Other heat-sensitive multicolor record materials can be prepared by similarly increasing the number of record layers.

When selecting the substances A and B, IR spectrum charts are first prepared for infrared absorbing substances such as those examplified above, over the wavelength range of 0.8 to 20 μm. From these charts are obtained a substance A having an absorption coefficient at the wavelength $\lambda_1$ of at least about $10^2$/cm (as measured at a concentration of 1 wt. % in potassium bromide, same as hereinafter) and a substance B having an absorption coefficient at the wavelength $\lambda_2$ of at least $10^2$/cm. Preferably $\lambda_1$ is at least about 0.2 μm different from $\lambda_2$. Not only a wavelength corresponding to an absorption peak, but also a wavelength nearly corresponding to the peak or corresponding to a shoulder is usable insofar as the absorption coefficient is at least about $10^2$/cm. The wavelengths $\lambda_1$ and $\lambda_2$ are selected according to the wavelength of the laser light source to be used. A carbon dioxide gas laser is especially useful since various laser beams having different wavelengths of about 9 to about 11 μm are available. Most preferably, the substance A should be one which selectively absorbs the laser beam of wavelength $\lambda_1$, but it is not critical that the substance A should in no way absorb the laser beam of wavelength $\lambda_2$ to be selectively absorbed by the substance B. In other words, the substance A may have an absorption coefficient of up to about $0.5\times10^2$/cm for the laser beam of wavelength $\lambda_2$ because when having an absorption coefficient of up to about $0.5\times10^2$/cm, the substance A is unable to release such heat energy as to give rise to the color forming reaction between the color forming material and the color developing material. Thus, the substances A and B can be selected easily. Three kinds of infrared absorbing substances can be selected similarly for use in heat-sensitive trichromatic record materials.

Table 1 shows preferred combinations of infrared absorbing substances and the useful absorption wavelengths thereof.

TABLE 1

| IR absorbing substance | Absorption wavelength (μm) |
|---|---|
| $Zn_2SiO_4$ | 10.6 |
| $BaSO_4$ | 9.2 |
| Talc* | 9.6 |
| $BaSO_4$ | 9.2 |
| $Zn_2SiO_4$ | 10.6 |
| Bis(1-thio-2-phenolate) nickel tetrabutylammonium | 1.06 |
| $BaSO_4$ | 9.2 |
| $CaMgSiO_4$ | 10.2 |
| $BaSO_4$ | 9.2 |
| $Ba_2MgSi_2O_7$ | 10.3 or 10.6 |
| $BaSO_4$ | 9.2 |
| $BaZn_2Si_2O_7$ | 10.2 or 10.6 |
| $BaSO_4$ | 9.2 |
| Talc* | 9.6 |
| $Sr_2SiO_4$ | 10.3 or 10.7 |
| $CaSO_4\ 2H_2O$ | 9.2 |
| Talc* | 9.6 |
| $Zn_2SiO_4$ | 10.6 |
| $Zn_2SiO_4$ | 10.6 |
| Talc* | 9.6 |
| $BaSO_4$ | 9.2 |

*finely divided talc (Trademark "MISTRON VAPOR", product of Nihon Mistron Co., Ltd., Japan)

The heat-sensitive multicolor record materials of this invention are not particularly limited in respect of the color forming temperature of each record layer, but if the color forming temperature differs too greatly from layer to layer, there arises a need to use an undesirably high light intensity, while it becomes likely to give color images having an obscure color contrast. Accordingly it is desirable that the difference between the maximum and the minimum of color forming temperature be up to 50° C., more desirably up to 10° C. When the color forming temperature differs from layer to layer, it is preferable to form the record layers in such an order that the color forming temperature will increase successively from the lower layer upward, since the color image then obtained is less likely to involve color mixing. Further because a beam of shorter wavelength is more likely to be scattered, it is desired to arrange the record layers so that the layer for which a laser beam of shorter wavelength is used for recording is positioned at a higher level.

With the multicolor record materials of this invention, it is preferable to interpose a heat insulating layer between two adjacent record layers, since the use of such heat insulating layer gives record images having more distinct color contrast and eliminates the problem of color mixing to the greatest extent. The material for forming the heat insulating layer is not limited particularly provided that it is low in thermal conductivity and has a low absorption coefficient for the laser beam to be used. Examples of useful materials are oxidized starch, gum arabic, gelatin, carboxymethylcellulose, methylcellulose, polyvinyl alcohol, polyethylene emulsion, styrene-butadiene copolymer latex, etc., which may be used singly or in admixture. The heat insulating layer is formed in a thickness generally of about 1 to about 10 μm, preferably about 1 to about 5 μm. In order to prevent the reduction in the density of record to be produced by the lower layer(s), a layer for preventing diffused reflection can be formed over the uppermost layer. This layer can be prepared, for example, from oxidized starch, gum arabic, gelatin, carboxymethylcellulose, methylcellulose, polyvinyl alcohol, polyethylene emulsion, styrene-butadiene copolymer latex or the like, generally in a thickness of about 1 to about 5 μm.

The method of forming the record layers of the multicolor record material of the invention is not particularly limited but can be any of conventional methods. For example, the coating composition for the record layer is applied to the base sheet by air knife coating or blade coating and then dried. The amount of the coating composition for each record layer, which is also not particularly limited, is generally about 2 to about 12 g/m$^2$, preferably about 3 to about 10 g/m$^2$, based on dry weight, so that the combined amount of the coating compositions for all the record layers will be about 6 to about 28 g/m$^2$ based on dry weight. The material of the base sheet is not particularly limited, either. Usual paper, synthetic fiber sheets, synthetic resin films, etc. are useful, and paper is generally preferable to use.

Although the multicolor record material of the invention generally comprises superposed record layers each containing a color forming system and a specific infrared absorbing substance for causing the system to form a color, the material is not limited to this structure. For example, the color forming systems and infrared absorbing substances can be applied by printing to a base sheet in the form of a single record layer or a plurality of record layers having a specified pattern. The material gives a sharp multicolor record when scanned by laser beams of different wavelengths in corresponding relation to the pattern.

Thus the present invention provides multicolor record materials in which the record layers are free from any undesired color formation and which give color images with a distinct color contrast and high sensitivity without the problem of color mixing of the record layers.

Useful recording light sources for giving laser beams of suitable wavelengths are a tunable (wavelength-variable) carbon dioxide gas laser, carbon monoxide gas laser, YAG (Yttrium-Aluminum-Garnet) laser, semiconductor laser (which may be of the tunable, i.e., wavelength-variable type) and like infrared lasers.

The present invention will be described with reference to the following examples, which are in no way limitative. The percentages in the examples are by weight.

EXAMPLE 1

A 10 g quantity of 3,3-bis(p-dimethylaminophenyl)-6-dimethylaminophthalide, 50 g of zinc silicate powder (1 μm in particle size), 30 g of 10% aqueous solution of polyvinyl alcohol and water were mixed together to obtain a dispersion (A) having a solids concentration of 25%. A 40 g quantity of 4,4'-isopropylidenediphenol, 20 g of 10% aqueous solution of polyvinyl alcohol and water were mixed together to obtain a dispersion (B) having a solids concentration of 25%. A 10 g quantity of 3-(N-ethyl-p-toluidino)-7-methylfluoran, 50 g of barium sulfate powder (1 μm in particle size), 30 g of 10% aqueous solution of polyvinyl alcohol and water were mixed together to prepare a dispersion (C) having a solids concentration of 25%. These dispersions (A) to (C) were each separately treated in a porcelain ball mill for 24 hours.

A heat-sensitive record coating composition for forming a blue color was prepared from 100 g of the dispersion (A), 50 g of the dispersion (B) and 10 g of styrene-butadiene-acrylate copolymer latex (50% in solids concentration). A heat-sensitive record coating composition for forming a red color was prepared from 100 g of the dispersion (C), 50 g of the dispersion (B) and 10 g of the same latex as above.

The coating composition for blue and then the coating composition for red were applied to non-coated paper weighing 49 g/m$^2$, each in an amount of 6 g/m$^2$ by dry weight, and then dried, to obtain a heat-sensitive dichromatic record paper.

The record paper was scanned at a speed of 2 m/sec for recording 10 lines/mm by a wavelength-variable carbon dioxide gas laser which was set to a wavelength of 10.6 μm at an output of 0.8 W to project a beam on the paper with a beam diameter of 150 μm thereon, whereby a blue image was obtained with a color density of 0.41 as measured by Macbeth densitometer with use of a red filter. Next, the record paper was used for recording under the same conditions as above, with the laser set to a wavelength of 9.2 μm, whereby a red image was obtained with a color density of 0.58 as measured by Macbeth densitometer with use of a blue filter. The two color images had a distinct color contrast without mixture of the two colors. Thus, no blue color was observed in the red image, while no red color was observed in the blue image.

The zinc silicate used has an absorption coefficient of $2.0\times10^2$/cm at the wavelength of 10.6 μm as measured at a concentration of 1 wt. % in potassium bromide, and the barium sulfate had an absorption coefficient of $2.4\times10^2$/cm at the wavelength of 9.2 μm as similarly measured. The barium sulfate substantially does not absorb the beam of wavelength of 10.6 μm, and the zinc silicate substantially does not absorb the beam of wavelength of 9.2 μm.

EXAMPLE 2

The same coating composition for forming a blue color as prepared in Example 1 was applied to non-coated paper weighing 49 g/m$^2$ in an amount of 6 g/m$^2$ by dry weight and then dried. The record layer was thereafter coated with 10% aqueous solution of polyvinyl alcohol in an amount of 2 g/m$^2$ by dry weight (about 2 μm in coating thickness), and the coating was dried to form a heat insulating layer.

The layer was further coated with the same coating composition for forming a red color as prepared in Example 1 in an amount of 6 g/m$^2$ by dry weight, and the coating was dried to obtain a heat-sensitive dichromatic record paper.

The paper was used for recording in two colors under the same conditions as in Example 1 except that the laser was set to an output of 1.1 W.

The paper gave a blue image with a color density of 0.62 as measured by Macbeth densitometer with use of a red filter and a red image with a color density of 0.80 as measured by Macbeth densitometer with use of a blue filter. Despite the higher energy used for recording, the color images had a distinct color contrast free from color mixing.

EXAMPLE 3

A heat-sensitive dichromatic record paper prepared exactly in the same manner as in Example 1 was coated, over the surface record layer, with 10% aqueous solution of polyvinyl alcohol in an amount of 1.5 g/m$^2$ by dry weight (about 1.5 μm in coating thickness), and the coating was dried to form a layer for preventing diffused reflection.

The paper obtained was used to cause the lower layer to produce a blue image in the same manner as in Example 1. The image had an improved color density of 0.55.

EXAMPLE 4

A heat-sensitive dichromatic record paper was prepared in the same manner as in Example 1 except that the zinc silicate powder for the dispersion (A) was replaced by finely divided talc (Trademark, "MISTRON VAPOR", product of Nihon Mistron Co., Ltd., Japan) as further pulverized by sand mill to a particle size of 3 μm.

The record paper was used for recording, making use of the absorption of the finely divided talc at a wavelength of 9.6 μm and the absorption of the barium sulfate at a wavelength of 9.2 μm, whereby a blue image and a red image were obtained which had a distinct color contrast and high color densities.

The finely divided talc has an absorption coefficient of $2.5\times10^2$/cm at the wavelength of 9.6 μm as measured at a concentration of 1 wt. % in potassium bromide. The talc does not absorb the beam of 9.2 μm substantially, while the barium sulfate does not absorb the beam of 9.6 μm substantially.

EXAMPLE 5

A heat-sensitive dichromatic record paper was prepared in the same manner as in Example 1 with the exception of using 3-diethylamino-7-dibenzylaminofluoran in place of 3,3-bis(p-dimethylaminophenyl)-6-dimethylaminophthalide for the dispersion (A) and using bis(1-thio-2-phenolate)nickel-tetrabutylammonium (about 2 μm in particle size) in place of barium sulfate for the dispersion (C).

The paper obtained was scanned at a speed of 2 m/sec for recording 10 lines/mm by YAG laser set to an output of 0.8 W to project a beam onto the paper with a beam diameter of 150 μm thereon, making use of the absorption at a wavelength of 1.06 μm of the bis(1-thio-2-phenolate)nickel-tetrabutylammonium, whereby a distinct red image was obtained.

Subsequently the paper was scanned at a speed of 2 m/sec for recording 10 lines/mm by a wavelength-variable carbon dioxide gas laser set to an output of 0.8 W to project a beam onto the paper with a beam diameter of 150 μm thereon, making use of the absorption of the zinc silicate at a wavelength of 10.6 μm, whereby a distinct green image was obtained. The color images had a sharp color contrast free from any color mixing.

EXAMPLE 6

A 10 g quantity of 3,3-bis(p-dimethylaminophenyl)-6-dimethylaminophthalide, 50 g of zinc silicate powder (1 μm in particle size), 30 g of 10% aqueous solution of polyvinyl alcohol and water were mixed together to obtain a dispersion (A) having a solids concentration of 25%. A 40 g quantity of 4,4'-isopropylidenediphenol, 20 g of 10% aqueous solution of polyvinyl alcohol and water were mixed together to obtain a dispersion (B) having a solids concentration of 25%. A 10 g quantity of 3-diethylamino-5-methyl-7-dibenzylaminofluoran, 50 g (calculated as solids) of finely divided talc (Trademark, "MISTRON VAPOR") as further pulverized by sand mill to a particle size of 3 μm, 30 g of 10% aqueous solution of polyvinyl alcohol and water were mixed together to prepare a dispersion (C) having a solids concentration of 25%. A 10 g quantity of 3-(N-ethyl-p-toluidino)-7-methylfluoran, 50 g of barium sulfate powder (1 μm in particle size), 30 g of 10% aqueous solution of polyvinyl alcohol and water were mixed together to prepare a dispersion (D) having a solids concentration of 25%. These dispersions (A) to (D) were each separately treated in a porcelain ball mill for 24 hours.

A heat-sensitive record coating composition for forming a blue color was prepared from 100 g of the dispersion (A), 50 g of the dispersion (B) and 10 g of styrene-butandiene-acrylate copolymer latex (50% in solids concentration). A heat-sensitive record coating composition for forming a green color was prepared from 100 g of the dispersion (C), 50 g of the dispersion (B) and 10 g of the same styrene-butadiene-acrylate copolymer latex (50% in solids concentration) as used above. A heat-sensitive record coating composition for forming a red color was prepared from 100 g of the dispersion (D), 50 g of the dispersion (B) and 10 g of the same styrene-butadiene-acrylate copolymer latex (50% in solids concentration) as used above.

Non-coated paper weighing 49 g/m$^2$ was coated with 6 g/m$^2$ by dry weight of the coating composition for forming a blue color and dried. The record layer was thereafter coated with 10% aqueous solution of polyvinyl alcohol in an amount of 2 g/m$^2$ by dry weight (about 2 μm in coating thickness), and the coating was dried to form a heat insulating layer.

The heat insulating layer was further coated with 4 g/m$^2$ by dry weight of the coating composition for forming a green color and dried. Subsequently, the record layer was coated with 2 g/m$^2$ by dry weight (about 2 μm in coating thickness) of 10% aqueous solution of polyvinyl alcohol and dried to form a heat insulating layer. This insulating layer was then coated with 4 g/m$^2$ by dry weight of the coating composition for forming a red color and dried. The record layer was further coated with 1.5 g/m$^2$ by dry weight (about 1.5 μm in coating thickness) of 10% aqueous solution of polyvinyl alcohol and dried to form a layer for preventing diffused reflection, whereby a heat-sensitive trichromatic record paper was obtained.

The record paper obtained was used for recording by a wavelength-variable carbon dioxide gas laser under the same conditions as in Example 1 in respect of scanning speed, line density and beam diameter. The paper developed a blue image with a color density of 0.65 (with use of Macbeth densitometer and red filter) at a wavelength of 10.6 μm and output of 1.2 W, a green image with a color density of 0.66 (with use of Macbeth densitometer and yellow filter) at a wavelength of 9.6 μm and output of 1.1 W, and a red image with a color density of 0.63 (with use of Macbeth densitometer and blue filter) at wavelength of 9.2 μm and output of 0.9 W. Each of the color images was free of mixture with the other colors. (For example, the blue image was free from green and red colors). The images had a sharp color contrast.

The infrared absorbing substances used above have an absorption coefficient of $2.0\times10^2$/cm at a wavelength of 10.6 μm for zinc silicate, $2.5\times10^2$/cm at a wavelength of 9.6 μm for finely divided talc and $2.4\times10^2$/cm at a wavelength of 9.2 μm for barium sulfate, as measured at a concentration of 1 wt. % in potassium bromide. Each of the substances substantially does not absorb the beams absorbed by the other two substances.

We claim:

1. A multicolor record material comprising a plurality of color forming systems each containing a color forming material and a color developing material and adapted to produce different colors individually, each of the color forming systems containing a substance which absorbs an infrared beam of specified wavelength for causing the system to produce its color but which substantially does not absorb an infrared beam of different wavelength for causing another system to produce the color thereof, the color forming systems being in the form of superposed record layers, each layer containing the substance which absorbs the infrared beam to be used for causing the system to produce its color, the infrared absorbing substance in each layer having relatively strong absorption within the wavelength range of about 0.8 to about 20 μm.

2. A multicolor record material as defined in claim 1 wherein the infrared absorbing substance in each layer has relatively strong absorption within the wavelength range of about 9 to about 11 μm.

3. A multicolor record material as defined in claim 1 wherein the infrared absorbing substance in each layer is an inorganic compound selected from the group consisting of metal oxide, metal hydroxide, silicate mineral, silicate compound, phosphate compound, nitride compound, sulfate compound, carbonate compound and nitrate compound.

4. A multicolor record material as defined in claim 1 wherein the infrared absorbing substance in each layer is an organic compound selected form the group consisting of triphenyl phosphate, 2-ethylhexyldiphenyl phosphate, furfuryl acetate, bis(1-thio-2-phenolate)nickel-tetrabutylammonium, bis(1-thio-2-naphtholate)nickel-tetrabutylammonium, 1,1'-diethyl-4,4'-quinocarbocyanine iodide and 1,1'-diethyl-6,6'-dichloro-4,4'-quinotricarbocyanine iodide.

5. A multicolor record material as defined in claim 1 wherein the infrared absorbing substance in each layer has an absorption coefficient of at least $10^2$/cm for the wavelength of the laser beam to be used, as measured at a concentration of 1 wt. % in potassium bromide.

6. A multicolor record material as defined in claim 1 wherein the infrared absorbing substance in each layer is in the form of particles up to about 10 μm in size.

7. A multicolor record material as defined in claim 1 wherein the infrared absorbing substance in each layer is used in an amount of about 3 to about 90 wt. % based on the total solids content of the record layer.

8. A multicolor record material as defined in claim 1 wherein the infrared beam to be absorbed by the substance contained in each system is at least 0.2 μm different in wavelength from the infrared beam to be absorbed by the substance contained in another system.

9. A multicolor record material as defined in claim 1 wherein a heat insulating layer is interposed between one of the record layers and another record layer adjacent thereto.

10. A multicolor record material as defined in claim 1 wherein a layer for preventing diffused reflection is formed over the uppermost record layer.

* * * * *